US005233183A

United States Patent [19]

Field

[11] Patent Number: 5,233,183

[45] Date of Patent: Aug. 3, 1993

[54] COLOR IMAGE INTENSIFIER DEVICE AND METHOD FOR PRODUCING SAME

[75] Inventor: Robert J. Field, Fincastle, Va.

[73] Assignee: ITT Corporation, New York, N.Y.

[21] Appl. No.: 736,716

[22] Filed: Jul. 26, 1991

[51] Int. Cl.[5] ..... H01J 31/50

[52] U.S. Cl. ..... 250/214 VT; 313/526

[58] Field of Search ..... 250/213 VT, 213 R; 313/524, 526; 358/211, 43

[56] References Cited

U.S. PATENT DOCUMENTS

| | | | |
|---|---|---|---|
| 3,610,932 | 10/1971 | Morse | 250/367 |
| 3,801,739 | 4/1974 | Geluk | 358/64 |
| 3,863,093 | 1/1975 | Orthuber | 250/213 VT |
| 3,875,449 | 4/1975 | Byler et al. | 313/466 |
| 3,912,386 | 10/1975 | Gorog et al. | 358/62 |
| 3,924,227 | 12/1975 | Stolov | 313/510 |
| 3,987,299 | 10/1976 | Mulder | 250/213 VT |
| 4,370,396 | 1/1983 | Sato et al. | 430/7 |
| 4,374,325 | 2/1983 | Howorth | 250/213 VT |
| 4,846,556 | 7/1989 | Haneda | 350/317 |
| 5,093,738 | 3/1992 | Watanabe et al. | 359/68 |

*Primary Examiner*—Paul M. Dzierzynski

*Assistant Examiner*—Jim Beyer

*Attorney, Agent, or Firm*—Arthur L. Plevy; Patrick M. Hogan

[57] ABSTRACT

An image intensifier device for producing a color output image includes in a proximity focused intensifier tube, an RGB color filter matrix screen printed upon a glass wafer which is laminated to the input faceplate of the tube and sandwiched between the faceplate and the photocathode. The RGB matrix filters incident light into RGB components which are amplified by the tube. The output image is colorized in a first embodiment by passing white light fluorescing from a phosphor layer through an RGB output filter matrix which is functionally aligned in an operating tube with the input matrix. In a second embodiment, a UV emanating phosphor layer excites an RGB matrix of secondary phosphors. In a third embodiment, IR filters are included in the RGB input matrix and a narrow band output filter is assigned to represent IR information in the RGB output matrix. In a fourth embodiment a plurality of RGB phosphors replace the phosphor layer of the previous embodiments and directly fluoresce color information.

30 Claims, 7 Drawing Sheets

COLOR IMAGE INTENSIFIER DEVICE AND METHOD FOR PRODUCING SAME

FIELD OF THE INVENTION

The present invention relates to an image intensifier and method for making same, and more particularly to an image intensifier having a color output image.

DESCRIPTION OF THE PRIOR ART

Image intensifiers for converting low intensity light images in the visible and near infrared regions of the electro-magnetic spectrum into higher intensity images for enhanced visualization are well known. For example, the military relies heavily upon image intensifiers to allow tactical operations to be conducted at night using equipment, such as, "night vision goggles". A variety of image intensifier types exist. One popular design employs a fiber optic input window through which the image from the environment is received into an evacuated intensifier tube envelope. A photon-to-photoelectron converting substance, such as ZnS, is formed in a layer on the interior face of the input window and comprises a photocathode. For examples of typical substances as well as image intensifier operation see the text entitled "Reference Data for Radio Engineers" published by H. W. Sams Co., Inc., ITT (1977), Chapter 17. When light travels through the input window and strikes the photocathode, photoelectrons are produced in proportion to the magnitude of the incident light. Subsequent to photoelectron generation, the electrons are accelerated and amplified by passage through a voltage gradient and one or more microchannel plates. The amplified electron signal is reconverted back into a light signal by directing the electron flow into a phosphorescent member, typically a phosphor layer deposited upon an output screen or window of the intensifier. Upon the electrons impacting the phosphorescent layer, light is emitted which propagates through the output window. It has been found that a fiber optic output window preserves image resolution. The input window and the output window typically constitute the end caps of the vacuum envelope which contains the photocathode, microchannel plate and phosphorescent member therein.

The aforegoing light intensification apparatus yields a monochromatic output image, in that the light to photoelectron conversion, electron flow amplification and reconversion into light do not preserve color. It is preferable, however, to view an image having color differentiation, because the coloration of objects in the field of view allows for greater image composition identification or "pattern recognition". For example, if a green object in the foreground has the same light intensity as a brown object forming the background for the green object, the green object will not be visible when viewed through a typical image intensifier. If the color definition of the input image were preserved, however, the foreground and background objects would be discernable based upon the difference in color between the objects rather than a difference in their light intensity.

Techniques for producing color images outside the image intensifier field are known. For example, it is known that various phosphors, when struck by electrons, will emit light of different colors. These phosphors, when arrayed in a particular pattern upon a display screen and coupled with a source of controlled irradiation, such as a scanning electron beam, provide a mechanism for producing color images in television tubes.

In the area of image intensifiers, at least one method has been proposed for generating color output images with an image intensifier. Such methods are described in the U.S. patent application, Ser. No. 07/662,268 of Robert Jett Field, Jr., the inventor herein, entitled COLOR IMAGE INTENSIFIER DEVICE, that application being assigned to the assignee herein, ITT Corporation. The application relates to an image intensifier fitted with a pair of moveable color members each having a plurality of color segments or portions for passing different light frequencies therethrough. One moveable, e.g., rotatable, color member is positioned over the input of the intensifier and the other is positioned over the output. The members are moved in synchronism, such that incident image light passing through the first member is amplified, reconverted and appropriately recolored upon output from the intensifier and passage through the second member.

It is an object of the present invention to provide a reliable and simple image intensifier that emits a color output image without employing rotating o reciprocating color members.

It is a further object to provide an efficient and reliable method for producing such an image intensifier.

SUMMARY OF THE INVENTION

The problems and disadvantages associated with conventional image intensifiers and techniques for producing them are overcome by the present invention which includes an image intensifier for producing a colored output image having an evacuated envelope with an input window for receiving an incident light image from the environment and an output window through which an output image is projected. Incident light is filtered by an input filter positioned in proximity to the input window. The input filter has at least two portions, a first portion passes light in a first selected range of wavelengths and a second portion passes light in a second selected range of wavelengths. The output image is colorized by a coloring element affixed proximate the output window. The coloring element has at least two portions, a first portion providing light of a first selected range of wavelengths and a second portion providing light of a second selected range of wavelengths. The input filter and coloring element are stationary and oriented and aligned relative to each other such that incident light passing through the first and second portions of the input filter generates an output signal from the intensifier which is colorized by the first and second portions of the coloring element. The present invention is produced by a method in which color input filters are first affixed in proximity to the input window for filtering the incident light. The intensifier is then assembled and placed in a darkened chamber. A first of at least two types of photosensitive coloring material is positioned proximate the output window and the intensifier is connected to a power supply and power is applied to the intensifier. While power is supplied to the intensifier, the input window is bathed in light in the first selected range of wavelengths, the light passing through the first portion of the input filters, initiates the intensification function of the intensifier, causing an output image to be projected out the output window, and exposes the first photosensitive coloring material. The photosensitive coloring material is then developed. The foregoing steps are repeated using another of the at least two types of photosensitive coloring material to yield a plurality of discrete coloring elements of at least two types, a first type issuing light representing the first selected range of wavelengths and a second type issuing light representing the second selected range of wavelengths.

BRIEF DESCRIPTION OF THE FIGURES

For a better understanding of the present invention, reference is made to the following detailed description of several exemplary embodiments considered in conjunction with the accompanying drawings, in which.

DETAILED DESCRIPTION OF THE FIGURES

Figure 1:
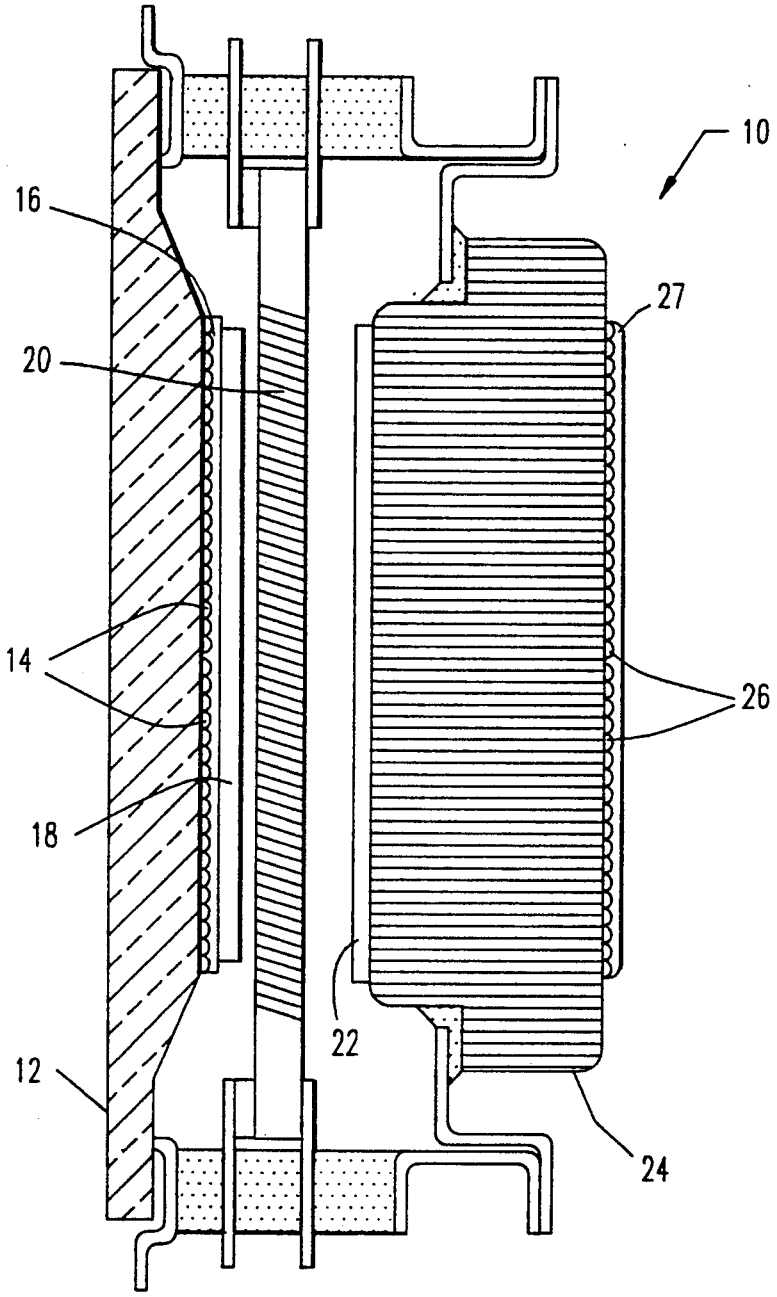
FIG. 1 is a cross-sectional view of an image intensifier in accordance with a first exemplary embodiment of the present invention, the cross-section being taken along the axis of the intensifier.

FIG. 1 shows an image intensifier 10 in accordance with the present invention having the capability to produce color images. The intensifier shown is similar in overall configuration to a monochromatic, "proximity focused" image intensifier. Although intensifiers having this general configuration are effective for producing color images in accordance with the present invention, the invention could also be practiced using other types of intensifiers. In operation, light from the field of view enters an input faceplate or window 12 formed from glass or fiber optic elements. Frequently, an optical lens (not shown) is used to focus the field of view image on the input faceplate 12. The input faceplate 12 is transparent to light of various wavelengths. Upon passing through the faceplate 12, the incident light encounters a first novel element of the present invention, viz., a plurality of discrete, spaced input color filter elements 14 that pass light of selected wavelengths and absorb, reflect, or otherwise block, light of non-selected wavelengths. The filter elements 14 are deposited on the faceplate 12 and can be either simple color absorption/-transmission filters, interference filters or semiconductor absorption filters, such as AlGaAs.

Figure 2:
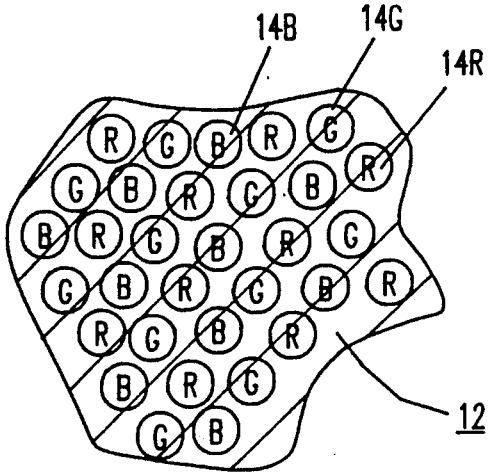
FIG. 2 is a fragmental front elevational view through the input faceplate of the image intensifier of FIG. 1 showing the pattern of color filter placement and distribution.

As has been known for many years, colors of the visible spectrum may be reproduced by combinations of three primary colors such as red, green and blue. The operation of a color TV receiver relies on the RGB principle. The input filters 14 of the present invention utilize a primary color set, such as RGB and they are positioned relative to one another in a pattern similar to a color television screen. Referring to FIG. 2, the arrangement of the color filters 14 can be appreciated as viewed through the front face of input screen 12. Each of the color filters and the reference numerals are labelled with a color designator letter, i.e., R-red, G-green, and B-blue.

Referring again to FIG. a glass layer 16 occupies a position between the filters 14 and a photocathode 18. The glass layer 16, besides constituting a structural element, is also employed in a preferred method of affixing the filters 14 to the faceplate 12 in a position sandwiched between the faceplate 12 and the photocathode 18. Namely, the filters 14 are screen printed onto a thin glass substrate, e.g., a wafer, which will become the glass layer 16 after assembly. The substrate i then placed intermediate the input faceplate 12 and the photocathode 18 and the three elements exposed to heat sufficient to render the substrate at least partially deformed. The elements may also be compressed together while being heated. The glass layer 16, input faceplate 12 and photocathode 18 are thereby merged into a unit. In accordance with this method, the thin glass substrate not only receives and transfers the pattern of the filter elements 14, but also serves as a means for bonding the filters 14 and the photocathode 18 to the faceplate 12. Of course, other methods for filtering the incident light prior to its impinging upon the photocathode 18 exist. For example, the filters 14 could be printed directly upon the inside face of the input faceplate 12 before affixation of the photocathode 18 or they could be printed or otherwise affixed (e.g., using photoresist techniques) on the outside surface of the input faceplate 12. The laminating method, however, provides an efficient and effective means of bonding both the filters 14 and the photocathode 18 to the faceplate at temperatures below which the faceplate becomes flowable. Further, the glass encapsulated filters 14 are very stable physically, chemically and electrically, being insulated from the external environment, from the photocathode 1 and from the electrical activity of the photocathode 18 and the other components of the intensifier tube 10.

Light passing through the filters 14 strikes the photocathode 18 and in response thereto, the photocathode 18 emits photoelectrons, in accordance with the normal operation of known image intensifiers. The electrons emitted from the photocathode are accelerated across a vacuum gap by an electrostatic field into a microchannel plate 20 which amplifies the electron signal. While a microchannel plate 20 is used to amplify the electron signal in the intensifier shown, any other known means of amplifying the signal could be employed. The amplified electron signal emitted by the microchannel plate 20 is accelerated through a second vacuum gap under the influence of an additional voltage gradient and collides into a phosphor element 22 deposited upon an output faceplate 24. In the embodiment depicted in FIG. 1, the phosphor element 22 is a white phosphor, i.e., when struck with electrons, it will glow with several wavelengths which in combination produce a white light. The white glow of the phosphor element or layer is then transmitted through the fiber optics of the output faceplate 24. Before the white light is permitted to exit the intensifier, however, it is passed through a grid of output color filter elements 26 which are color matched and spacially aligned with the input color filter elements 14, such that the output image is appropriately recolored before transmission to the viewer. A protective coating 27 of a clear lacquer or epoxy may be applied over the output color filter elements 26 to protect them from physical damage.

Figure 3:
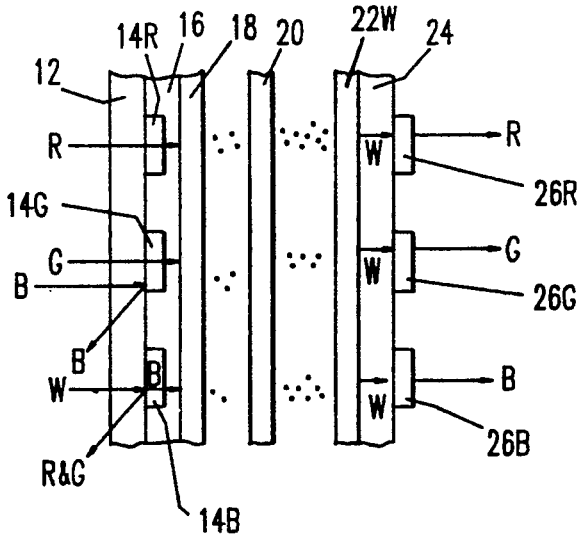
FIG. 3 is a diagrammatic, cross-sectional view of an image intensifier as shown in FIGS. 1 and 2 in operation.

The above described operation can be appreciated more completely by examining FIG. 3. In FIG. 3, a portion of an incident light image having four discernable colored rays, i.e., red, green, blue and white, is shown passing through the input faceplate. The four distinct colored rays are schematically represented by arrows labelled R(ed), G(reen), B(lue) and W(hite). The colored rays are shown impinging upon three input color filters: 14R, a red filter, 14G, a green filter and 14B, a blue filter. When the red ray strikes the red filter 14R, the red light passes through and hits the photocathode 18, causing the emission of photoelectrons. The photoelectrons emitted are accelerated to and amplified by the microchannel plate 20. Upon leaving the microchannel plate 20, the amplified signal collides into the phosphor element 22W, which, in this embodiment, has been selected to emit white light when activated. White light emitted by the phosphor element 22W travels through the output faceplate 24, which is preferably a fiber optic member for the purpose of preserving resolution. The output filter elements 26R, G and B arranged on the outer face of the output faceplate 24 color the white light transmitted through the faceplate to correspond to the color of the input or incident light. For example, the signal generated and amplified as a result of red light passing through 14R is colored red upon leaving the intensifier by the output filter 26R. A blue incident light ray is depicted as being reflected from filter 14G, whereas a green ray is permitted to pass through and initiate the above-described light amplification and recolorization. The blue portion of a ray of white light is shown passing through 14B, thereafter being converted to photoelectrons, amplified, reconverted to white light, transmitted through the output screen and colorized blue by a blue output filter 26B. The remainder of the spectrum in the white light is filtered out either by reflection or absorption by filter 14B.

As can be appreciated by the foregoing description, the recolorizing function of the present invention is dependent upon the alignment of the input 14 and output 26 color filters. That is, a color pixel located at a position (x,y) in the field of view must occupy the same (x,y) position in the output image in order for the output image to be accurately colored. This is true of all the pixels of each color. Initially, it may appear that the simplest expedient for obtaining this condition of alignment is to create a duplicate pair of filter grids, i.e., one for input and one for output. Given an image intensifier which is physically, electrically and functionally symmetrical and predictable, e.g., non-inverting, non-distorting and precisely coaxial, the proposed input and output grids could then be mechanically aligned by, e.g., indexing relative to a common reference guide. There are, however, certain limitations to tube performance and construction which tend to suggest against this strategy. Namely, given the large number of color elements and the density of their distribution upon a grid pattern of even modest resolution, the input and output filter planes would have to be parallel within a very small range of tolerance. This would require an extremely precise composite tube cylinder, input and output faceplate mounting and filter installation on the input and output faceplates, as well as, precise coaxiality. These difficulties may be surmounted by recognizing the fact that both patterns could be made highly regular, both with respect to the repetition of the pattern and with respect to each other. This, in combination with an adjustable faceplate which permits moving one of the filter grids relative to the other, would allow the repeating patterns to be aligned interactively as the tube is operated. This solution does not provide maximal alignment, however, in those instances where an intensifier tube has a certain amount of intrinsic internal inaccuracy and distortion. For example, tubes may distort the spacing between pixels at the output plane (at the output faceplate 24) from that which appears on the input plane (at the input faceplate 12).

Figure 4:
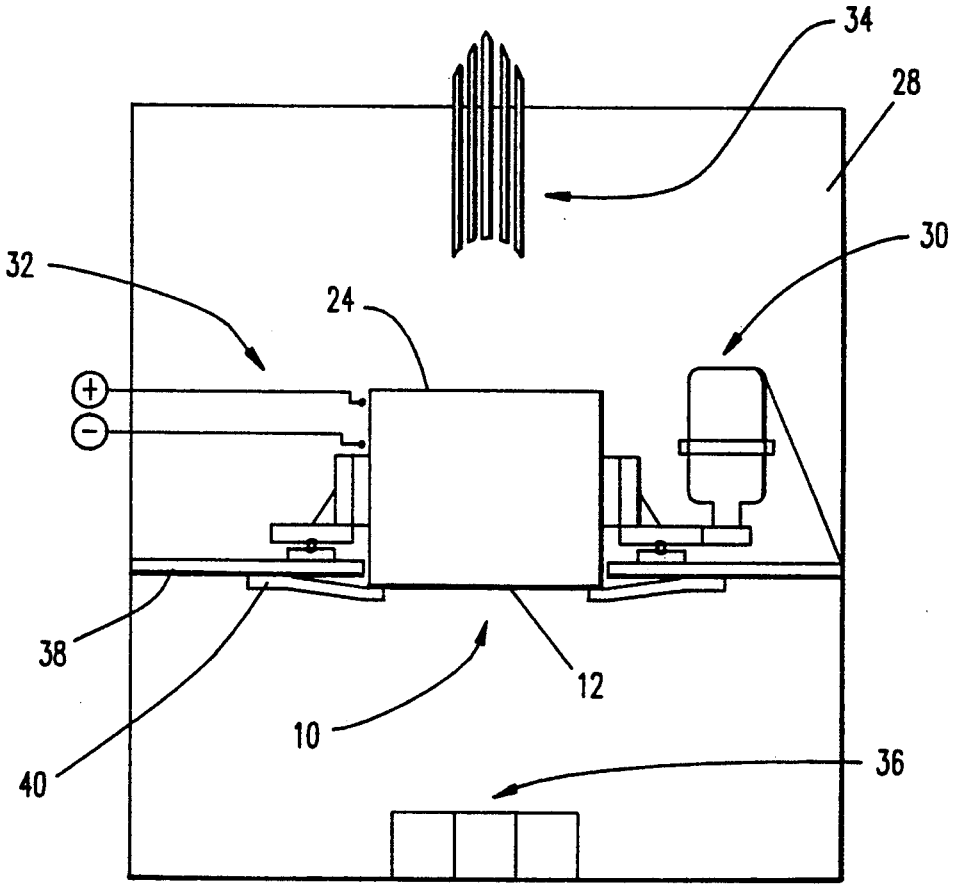
FIG. 4 is a diagrammatic depiction of a mechanism for producing a color image intensifier in accordance with methodology of the present invention.

A preferred method of production in accordance with the present invention avoids the filter misalignment problems posed by the inherent inaccuracy of known intensifier tubes by employing a method of forming of the grid of output filter elements 26 that is based upon the actual output characteristics of the particular tube. Given a sealed, operational intensifier tube 10 having a grid of input filter elements 14 affixed to the input faceplate 12 and a white output phosphor element 22W, the appropriate output color filters 26 can be formed in the proper positions on the outer surface of the output screen 24 as follows. Referring to FIG. 4, the tube is placed in a dark chamber 28 having a tube spinning device 30, tube power supply connections 32, a plurality of dispenser outlets 34 for dispensing different colored photoresist (red, green and blue) and photoresist solvent, as well as, a source of red, green and blue light 36. With all light and electrical power to the tube off, a quantity of red tinted photoresist, which when developed would act as a light filter passing red light, is deposited upon the output faceplate 24 of the intensifier 10. The intensifier 10 is then spun by the spinning device 30 to distribute the photoresist in an even layer. The tube 10 is then rotated to a position where its electrical terminals contact the tube power supply connections 32. Since there is no light in the darkened chamber 28, there is, at this stage, no light output from the tube, even when it is powered on. The light source 36 is then illuminated such that red light is emitted and enters the input faceplate 12 of the intensifier 10. The output is shielded from the red input light by a partition 38 and gasket 40. Only the red input filter elements 14 (subpixels) pass the red light and the tube responds only at these discrete locations and creates an output at a corresponding set of discrete locations on the output faceplate 24. If negative working photoresist is employed to coat the output faceplate 24, the areas of photoresist overlying the positions where an output response is generated will be developed. After the illuminated areas have been developed, the red light is turned off. Photoresist solvent is then sprayed from one of the dispenser outlets 34 upon the output faceplate 24 to wash off all undeveloped red photoresist. This leaves islands of red-tinted photoresist which will act as the red output filter elements 26R and which are positioned at precisely the correct positions to colorize the output signal initiated by red input light. Green tinted photoresist is then applied and spincoated on. The green light is then turned on such that the activated tube will develop appropriate islands of green-tinted photoresist when the undeveloped portions are rinsed away with solvent. The blue photoresist is then applied, developed, etc. The filter element pattern that remains after this sequence of operations is precisely aligned with the input filter pattern, even though the intervening image intensification apparatus may have inherent distorting effects.

Figure 5:
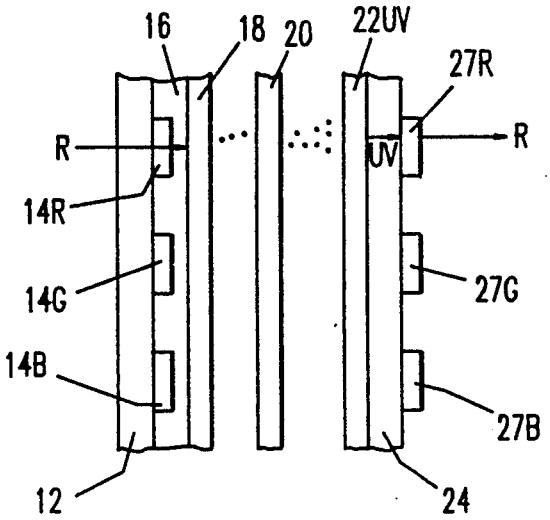
FIG. 5 is a diagrammatic, cross-sectional view of an image intensifier in accordance with a second embodiment of the present invention in operation.

Another embodiment of the present invention, as shown in FIG. 5, is realized by substituting ultraviolet (UV) radiating phosphor 22UV for the white light radiating phosphor 22W of the previous embodiment and UV-responsive colored secondary phosphors 27R, 27G and 27B in place of the colored output filter elements 26R, 26G and 26B. The red, green and blue UV-responsive phosphors, which fluoresce when irradiated with ultraviolet light, are placed upon the output screen 24 in basically the same manner as the colored output filters 26 of the previous embodiment. That is, the phosphors are individually mixed with negative-acting, clear photoresist and sequentially applied by spin coating, exposure, development and washing with solvent within a light controlled spincoating apparatus like that shown in FIG. 4.

Figure 6:
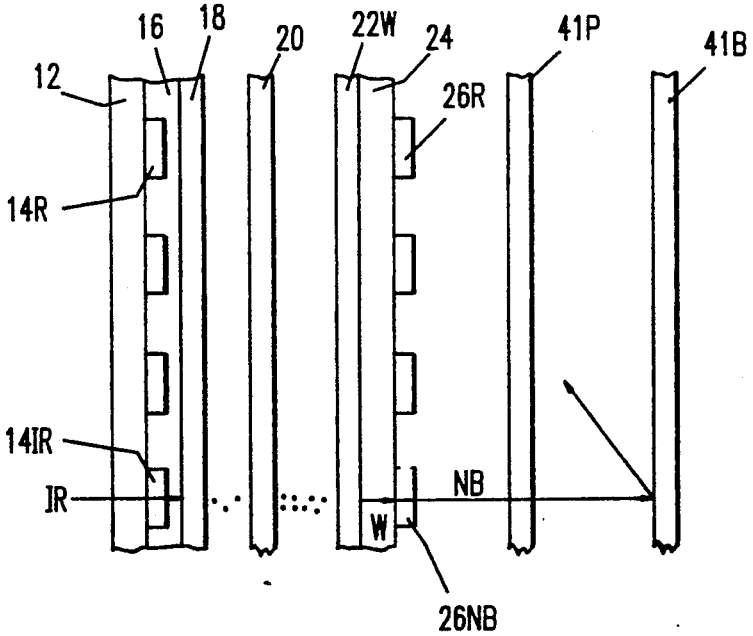
FIG. 6 is a diagrammatic, cross-sectional view of an image intensifier in accordance with a third embodiment of the present invention in operation.

A third embodiment of the present invention is shown in FIG. 6, wherein white phosphor and color output filters are used as in the first embodiment, but a fourth type of input filter 14IR is employed which passes only infrared radiation. The incident infrared signal is amplified and converted into a white light signal like the visible input light signal. The output filter 26NB which is used to correspond to infrared input positions, however, is simply a color filter like 26R, G and B which passes a selected narrow band of color in the visible spectrum. The particular color selected to represent the infrared output signal is preferably one which is not common to the field of view in the area in which the intensifier is used. For example, with the exception of certain birds or flowers, hot pink is generally not encountered in the natural environment and therefor could be used to distinguish the infrared image from visible spectrum radiations in the field of view. If it is desired to view only the infrared portion of the incident radiation, a filter 41P which passes only the selected narrow band could be superimposed over the output image. If it is desirable to suppress the infrared information, an alternative filter 41B which passes all but the selected narrow band used to represent infrared may be employed. In preparing this embodiment, the light source 36 shown in FIG. 4 would possess the capability of emitting infrared radiation for the purpose of developing the photoresist comprising the infrared color filter element 26IR. If a narrow band color other than red, green or blue is selected to represent infrared on output, a fourth dispenser outlet 34 of the narrow band-tinted photoresist would be required. It should further be noted that each input pixel would be comprised of four subpixels, viz., R, G, B and IR. Similarly, the output pixels would have four subpixels, viz., R, G, B and NB.

Figure 7:
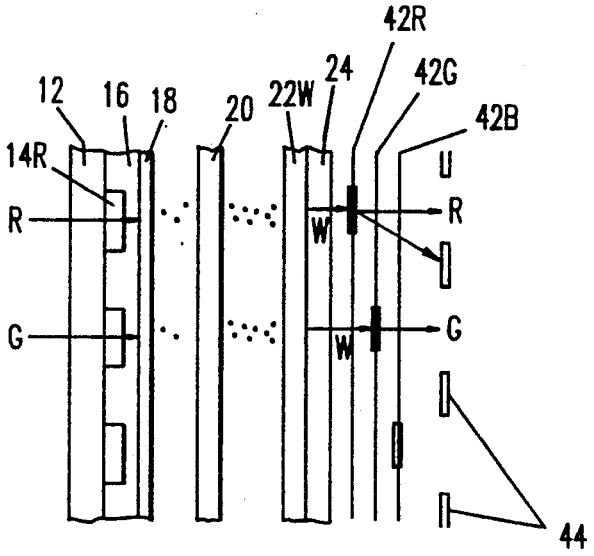
FIG. 7 is a diagrammatic, cross-sectional view of an image intensifier in accordance with a fourth embodiment of the present invention in operation.
Figure 8:
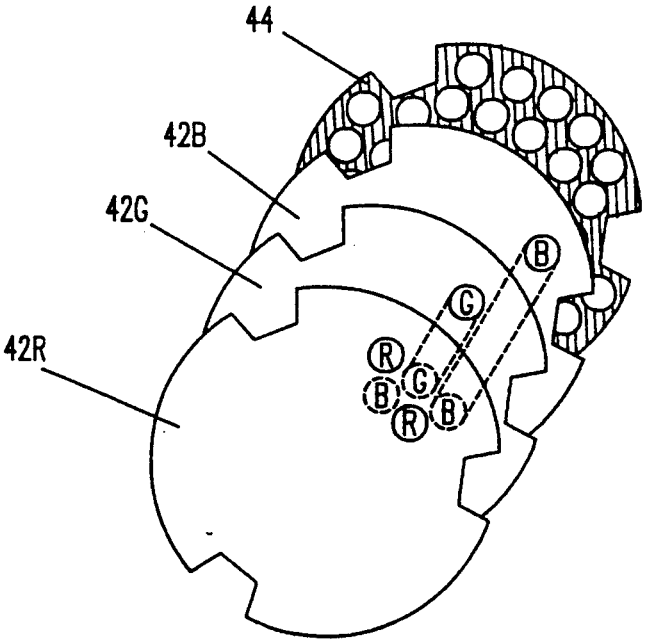
FIG. 8 is an exploded perspective view of a color filter and mask set employed on the output of the image intensifier of FIG. 7.

A fourth embodiment of the present invention is illustrated in FIGS. 7 and 8, wherein a set of photographic films 42R, 42G and 42B is used in place of the photoresist color output filters 26R, 26G and 26B of the first embodiment (as shown in FIGS. 1 and 3). In the fourth embodiment, a first film which develops red when exposed to light and clear when not exposed is placed on the output faceplate 24 of the intensifier 10 which is contained within a dark chamber 28 like that shown in FIG. 4. The intensifier is turned on and the input of the intensifier bathed in red light thereby exposing the film. The red film is then removed and developed. The process is repeated for the green and blue films, and, if desired, for fourth color film to represent IR. When all the developed films are placed in position over the output screen, a color filter grid equivalent to that accomplished by the previously described photoresist method is realized. A black saturation mask 44 having a plurality of transparent cells in a black matrix may be prepared from film. This mask would be formed by a black-and-white transparency film with high exposure contrast such that when one color of subpixels is exposed, the less-saturated edges of each subpixel remain black. As an alternative, a gel film could be used which becomes transparent on exposure, such that the unexposed gel diffuses back into each exposed subpixel to make it smaller, thus obscuring the edges. It is the edges of each subpixel which potentially overlap at the output screen. As can be seen in FIG. 7, the mask 44 absorbs light radiated in unintended directions and thus enhances resolution and color definition. It should be observed that each film, shown here as a disk-shaped member, must have means for registering and being retained in association with the intensifier output. This registration may be accomplished, e.g., by grooves formed in the periphery of the disks which would receive lands projecting inwardly from a cylindrical receiver positioned around the periphery of the output screen 24 of the intensifier 10. Of course, there are numerous expedients for achieving this relative reproducible alignment. Similarly, the films may be retained in association with the intensifier by a number of means within the expertise of a normally skilled artisan, such as, by gluing, under the pressure of a spiral spring acting between a peripheral lip and a retaining ring, or by means of a threaded sleeve and mating internal retainer ring.

Figure 9:
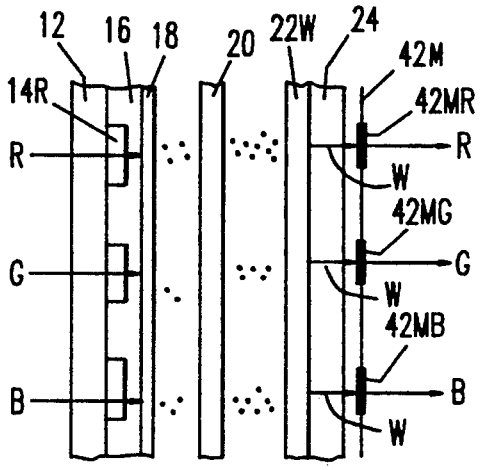
FIG. 9 is a diagrammatic, cross-sectional view of an image intensifier in accordance with a fifth embodiment of the present invention in operation.
Figure 10:
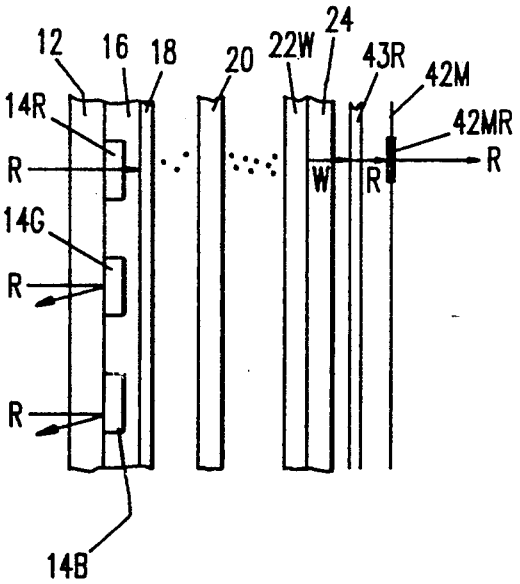
FIG. 10 is a diagrammatic, cross-sectional view of an image intensifier in accordance with the fifth embodiment of FIG. 9 being produced in accordance with a method of the present invention.

FIG. 9 illustrates another embodiment of the present invention utilizing a film output filter element. In this embodiment, the separate films 42R, 42G and 42B of the previously described embodiment are replaced with a single multi-color transparency film 42M, such as that used for standard commercial 35 mm slides. The exposure process is the same as that previously described except that R, G and B filters are sequentially imposed between the film 42M and the white output phosphor 22W. FIG. 10 shows, e.g., that during red light exposure, a red filter 43R would convert the white light generated by phosphor 22W into a red light signal which would create a red developing area 42MR on the film 42M. As before, during red light exposure as depicted in FIG. 10, input filters 14G and 14B would reflect, absorb or otherwise fail to transmit the red incident light such that only the appropriate areas of film 42M are red-exposed. The same process is repeated, substituting a green filter 43G (not shown) during green light exposure and a blue filter 43B (not shown) during blue light exposure. Unexposed areas of the film develop black.

Figure 11:
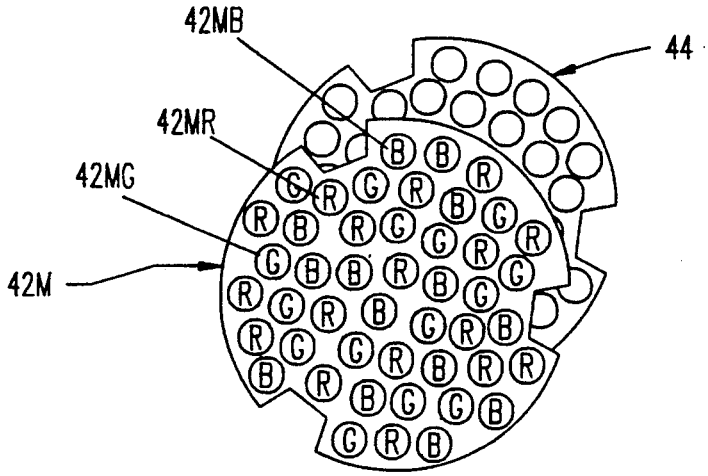
FIG. 11 is an exploded perspective view of a color filter and mask set employed on the output of the image intensifier of FIGS. 9 and 10.

FIG. 11 shows film 42M after having been sequentially exposed to R, G and B light whereby localized red transmitting 42MR, green transmitting 42MG and blue transmitting 42MB areas are produced. As before, the film can be used in combination with a suitable saturation mask 44, produced as described above.

Figure 12:
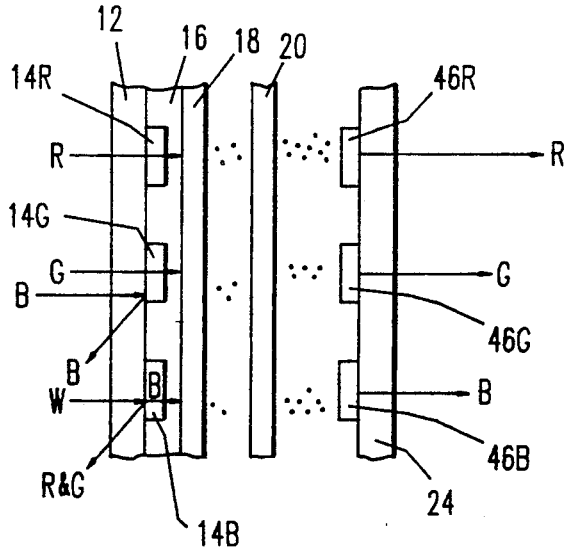
FIG. 12 is a diagrammatic, cross-sectional view of an image intensifier in accordance with a sixth embodiment of the present invention in operation.

FIG. 12 shows yet another embodiment of the present invention wherein the white or UV phosphor element 22W or 22UV and discrete color output filters elements 26R, G and B or the secondary UV-responsive phosphors 27R, G and B of the aforementioned embodiments are replaced with a set of discrete red, green and blue primary, internal, output phosphors 46R G and B affixed to the interior surface of the output screen 24. In this embodiment, the amplified electron signal from the microchannel plate 20 is translated into colored light by the discrete output phosphor elements 46R, G and B. Each phosphor element 46R, G and B emits light of a frequency corresponding to that passed by a corresponding input filter element 14R, G and B. For example, red light passing through the upper red filter 14R generates the intensification sequence described and causes an amplified electron signal to strike a phosphor element 46R which emits red light. Besides being located on the interior face of the output screen 24, the output phosphor elements 46 are arranged on the output screen in the same basic fashion as the output filters 26 are arranged on the output screen of previously described embodiments, such as illustrated in FIG. 3. Of course, the input filter elements 14 on the input screen 12 and the output phosphor elements 46 on the output screen 24 must be aligned to cooperate in the desired manner.

This alignment may be accomplished as follows. With the exception of the output faceplate 24, phosphor elements 46, and output color filters 26 which are not used in this embodiment, the remainder of the intensifier 10 may be assembled in the same manner as previously described. Since the output phosphors 46 are formed on an internal surface of the output faceplate 24, the output faceplate must be removably affixed to the tube envelope in order to apply the different phosphors in successive steps, as shall be apparent from the procedure discussed below. It is also important that the removeable output faceplate 24 be provided with lugs, teeth or other indexing means whereby the registration of the output faceplate with the tube is precisely reproducible. Given these characteristics in the output faceplate 24 and intensifier tube, the different colored output phosphor elements 46 may be applied to the output faceplate 24 by mixing each of the phosphors in a separate quantity of clear, negative acting photoresist that cures or cross-links upon exposure to electron bombardment; applying and spin coating the faceplate with a first of the mixtures in a darkened chamber; assembling the faceplate 24 to the tube; evacuating the tube; powering the tube with electric power; exposing the assembled, powered tube to light of a frequency corresponding to the output frequency of the phosphor applied; removing the faceplate from the tube; washing the unexposed photoresist from the faceplate 24 with solvent; and repeating this sequence for each color phosphor utilizing the indexing means to assure that the faceplate is always installed in the same position. Since the tube must be evacuated to conduct each successive exposure, the removable output faceplate must either be sealably engaged to the tube and evacuated prior to each exposure session or the darkened chamber must be evacuable, with a load-lock to allow removal of the screen for processing. After all the output color phosphors 46 have been affixed to the output faceplate, the tube can be assembled for the last time, evacuated and permanently sealed. As an alternative to the mixture of different colored phosphors with clear photoresist, a uniform phosphor mixed with a variety of tinted photoresists could be employed to effect the RGB matrix of output elements.

In each of the foregoing embodiments, the correspondence between incident light color and coloration of the output image is discretionary. While coloration is, in many circumstances, most desirable, false color images can also be produced using the present invention merely by substituting input and output color correspondence during manufacture, as described above.

It should be understood that the embodiments described herein are merely exemplary and that a person skilled in the art may make many variations and modifications without departing from the spirit and scope of the invention as defined in the appended claims.

I claim:

1. An image intensifier for producing a colored output image, comprising;

(a) an evacuated envelope having an input window for receiving incident light from the environment into said intensifier and a filter optic output window through which an output image is projected from said intensifier;

(b) input filter means affixed proximate said input window for filtering said incident light, a first portion of said input filter means passing red light, a second portion passing green light and a third portion passing blue light, said first, second and third portions of said input filter means each subdivided into a plurality of input filters interspersed and distributed in a generally planar configuration parallel to said input window;

(c) output coloring means affixed proximate said output window for coloring said output image, a first portion of said output coloring means providing red light, a second portion providing green light and a third portion providing blue light, said first, second and third portions of said output coloring means each subdivided into a plurality of coloring elements, interspersed and distributed in a generally planar configuration parallel to said output window, said output coloring means and said input filter means being stationary with respect to said intensifier when producing said output image and having a spacial alignment relative to each other, said input filters of said first, second and third portions of said input filter means having an approximate one-to-one correspondence with said coloring elements of said first, second and third portions of said output coloring means, respectively, such that incident light passing through said first, second and third portions of said input filter means generates an output signal from said intensifier which is colorized by said first, second and third portions, respectively, of said output coloring means to represent the coloring of said incident light; and (d) a photocathode contained within said envelope for converting said incident light passing through said input window and said input filter means into a photoelectron signal, amplifying means contained within said envelope for amplifying said photoelectron signal into an amplifier signal and reconverting mean contained within said envelope for converting said amplified signal into a visible light output image, said reconverting means being a phosphor layer deposited upon a surface of said output window interior to said envelope, said coloring elements being color absorption/transmission filters of tinted photoresist deposited upon a surface of said output window exterior to said envelope, said phosphor layer emitting several wavelengths of light in the visible region when struck by said amplified signal, said light of several wavelengths approximating white light and propagating through said output window and said output filters, said output image being colorized, said input filters being screen printings upon a glass substrate, said glass substrate sandwiched between and bonded with said input window and said photocathode.

2. The device of claim 1, wherein said input filters are color absorption/transmission filters.

3. The device of claim 2, wherein a protective substantially transparent coating is applied over said output filters and said output window.

4. The device of claim 3, wherein said image intensifier is of the proximity focused type and said amplifying means is a microchannel plate.

5. An image intensifier for producing a colored output image, comprising:

(a) an evacuated envelope having an input window for receiving incident light from the environment into said intensifier and an output window through which an output image is projected from said intensifier;

(b) input filter means affixed proximate said input window for filtering said incident light, a first of at least two portions of said input filter means passing light in a first selected range of wavelengths and a second portion passing light in a second selected range of wavelengths, said at least two portions of said input filter means each subdivided into a plurality of input filters interspersed and distributed in a generally planar configuration parallel to said input window;

(c) output coloring means affixed proximate said output window for coloring said output image, a first of at least two portions of said output coloring means providing light of one selected range of wavelengths and a second portion providing light of another selected range of wavelengths, said at least two portions of said output coloring means each subdivided into a plurality of coloring elements, interspersed and distributed in a generally planar configuration parallel to said output window, said output coloring means and said input filter means being stationary with respect to said intensifier when producing said output image and having a spacial alignment relative to each other, said input filters of said first position of said input filter means having an approximate one-to-one correspondence with said coloring elements of said first portion of said output coloring means and said input filters of said second portion of said input filter means having an approximate one-to-one correspondence with said coloring elements of said second portion of said output coloring means, such that incident light passing through said first and second portions of said input filter means generates an output signal from said intensifier which is colorized by said first and second portions, respectively, of said output coloring means to represent the coloring of said incident light; and (d) conversion means contained within said envelope for converting said incident light passing through said input window and said input filter means into a photoelectron signal, amplifying means contained within said envelope for amplifying said photoelectron signal into an amplified signal and reconverting means contained within said envelope for reconverting said amplified signal into a visible light output image, said reconverting means being a phosphor layer deposited upon a surface of said output window interior to said envelope and said coloring elements being secondary output phosphors deposited upon a surface of said output window exterior to said envelope, said phosphor layer emitting electromagnetic radiation in a selected wavelength range when struck by said amplified signal, said radiation propagating through said output window and striking said secondary output phosphors causing said secondary output phosphors to fluoresce and colorize said output image.

6. The device of claim 5, wherein said electromagnetic radiation is ultraviolet light.

7. The device of claim 6, wherein said output window is composed of fiber optic elements.

8. The device of claim 7, wherein said at least two portions of said input filter means are three in number, a first passing red light, a second passing green light and a third passing blue light and wherein said at least two portions of said output coloring means are three in number, a first fluorescing red light, a second fluorescing green light and a third fluorescing blue light.

9. The device of claim 8, wherein said output image attributable to incident light passing through red, green and blue input filters is colorized by red, green and blue fluorescing secondary output phosphors, respectively.

10. The device of claim 9, wherein said secondary output phosphors are retained within a matrix of cross-linked photoresist.

11. The device of claim 10, wherein said converting means is a photocathode, said input filters are screen printings upon a glass substrate, said glass substrate is sandwiched between and bonded with said input window and said photocathode.

12. The device of claim 11, wherein said input filters are color absorption/transmission filters.

13. The device of claim 12, wherien a protective substantially transparent coating is applied over said secondary output phosphors and said output window.

14. The device of claim 13, wherien said image intensifier is of the proximity focused type and said amplifying means is a microchannel plate.

15. An image intensifier for producing a colored output image, comprising:

(a) an evacuated envelope having an input window for receiving incident light from the environment into said intensifier and an output window through which an output image is projected from said intensifier;

(b) input filter means affixed proximate said input window for filtering said incident light, a first of at least two portions of said input filter means passing light in a first selected range of wavelengths and a second portion passing light in a second selected range of wavelengths said at least two portions of said input filter means each subdivided into a plurality of input filters interspersed and distributed in a generally planar configuration parallel to said input window;

(c) output coloring means affixed proximate said output window for coloring said output image, a first of at least two portions of said output coloring means providing light of one selected range of wavelengths and a second portion providing light of another selected range of wavelengths, said at least two portions of said output coloring means each subdivided into a plurality of coloring elements, interspersed and distributed in a generally planar configuration parallel to said output window, said output coloring means and said input filter means being stationary with respect to said intensifier when producing said output image and having a spacial alignment relative to each other, said input filters of said first portion of said input filter means having an approximate one-to-one correspondence with said coloring elements of said first portion of said output coloring means and said input filters of said second portion of said input filter means having an approximate one-to-one correspondence with said coloring elements of said second portion of said output coloring means such that incident light passing through said first and second portions of said input filter means generates an output signal from said intensifier which is colorized by said first and second portions, respectively, of said output coloring means to represent the coloring of said incident light; and (d) conversion means contained within said envelope for converting said incident light passing through said input window and said input filter means into a photoelectron signal, amplifying means contained within said envelope for amplifying said photoelectron signal into an amplified signal and reconverting means contained within said envelope for reconverting said amplified signal into a visible light output image, said reconverting means being said coloring elements, said coloring elements being islands of phosphor deposited upon said output window interior of said envelope, said phosphor islands of said first and second portions of said output coloring means fluorescing light of said one and another selected ranges of wavelengths, respectively, when struck by said amplified signal, said light fluoresced by said phosphor islands being propagated through said output window to constitute a colored said output image.

16. The device of claim 15, wherein said output window is composed from fiber optic elements.

17. The device of claim 16, wherein said at least two portions of said input filter means are three in number, a first passing red light, a second passing green light and a third passing blue light and wherein said at least two portions of said output coloring means are three in number, a first fluorescing red light, a second fluorescing green light and a third fluorescing blue light.

18. The device of claim 17, wherein said output image attributable to incident light passing through red, green and blue input filters is colorized by red, green and blue fluorescing phosphor islands, respectively.

19. The device of claim 18, wherein said phosphor islands include phosphor retained within a matrix of crosslinked photoresist.

20. The device of claim 19, wherein said converting means is a photocathode, said input filters are screen printings upon a glass substrate, and said glass substrate is sandwiched between and bonded with said input window and said photocathode.

21. The device of claim 20, wherein said input filters are color absorption/transmission filters.

22. The device of claim 21, wherein said image intensifier is of the proximity focused type and said amplifying means is a microchannel plate.

23. An image intensifier for producing a colored output image, comprising:

(a) an evacuated envelope having an input window for receiving incident light from the environment into said intensifier and an output window through which an output image is projected from said intensifier;

(b) input filter means affixed proximate said input window for filtering said incident light, a first portion of said input filter means passing red light, a second portion passing green light, a third portion passing blue light and a fourth portion passing infrared radiation, said first, second, third and fourth portions of said input filter means each subdivided into a plurality of input filters interspersed and distributed in a generally planar configuration parallel to said input window; and (c) output coloring means affixed proximate said output window for coloring said output image, first portion of said output coloring means providing red light, a second portion providing green light, a third portion providing blue light and a fourth portion providing light of a selected visible wavelength, said first, second, third and fourth portions of said output coloring means each subdivided into a plurality of coloring elements interspersed and distributed in a generally planar configuration parallel to said output window, said output coloring means and said input filter means being stationary with respect to said intensifier when producing said output image and having a spacial alignment relative to each other, said input filters of said first, second, third and fourth portions of said input filter means having an approximate one-to-one correspondence with said coloring elements of said first, second, third and fourth portions of said output coloring means, such that incident light passing through said first, second, third and fourth portions of said input filter means generates an output signal from said intensifier which is colorized by said first, second, third and fourth portions, respectively, of said output coloring means.

24. The device of claim 23, wherein said output image attributable to incident light passing through said red, green, blue and infrared input filters is colorized by red, green, blue and said selected visible wavelength output filters, respectively.

25. The device of claim 25, further including a removeable separate filter positioned proximate said output window for filtering said output image after colorization, said separate filter passing only light of said selected wavelength, such that only infrared information is depicted in said output image.

26. The device of claim 25, further including an alternative removeable separate filter positioned proximate said output window for filtering said output image after colorization, said alternative filter blocking light of said selected wavelength, such that no infrared information is depicted in said output image.

27. An image intensifier for producing a colored output image, comprising:

(a) an evacuated envelope having an input window for receiving incident light from the environment into said intensifier and an output window through which an output image is projected from said intensifier;

(b) input filter means affixed proximate said input window for filtering said incident light, a first of at least two portions of said input filter means passing light in a first selected range of wavelengths and a second portion passing light in a second selected range of wavelengths said at least two portions of said input filter means each subdivided into a plurality of input filters interspersed and distributed in a generally planar configuration parallel to said input window;

(c) output coloring means affixed proximate said output window for coloring said input image, a first of at least two portions of said output coloring means providing light of one selected range of wavelengths and a second portion providing light of another selected range of wavelengths, said at least two portions of said output coloring means each subdivided into a plurality of coloring elements interspersed and distributed in a generally planar configuration parallel to said output window, said output coloring means and said input filter means being stationary with respect to said intensifier when producing said output image and having a spatial alignment relative to each other, said input filters of said first portion of said input filter means having an approximate one-to-one correspondence with said coloring elements of said first portion of said output coloring means and said input filters of said second portion of said input filter means have an approximate one-to-one correspondence with said coloring elements of said second portion of said output coloring means such that incident light passing through said first and second portions of said input filter means generates an output signal from said intensifier which is colorized by said first and second portions, respectively, of said output coloring means to represent the coloring of said incident light; and (d) conversion means contained within said envelope for converting said incident light passing through said input window and said input filter means into a photoelectron signal, amplifying means contained within said envelope for amplifying said photoelectron signal into an amplified signal and reconverting means contained within said envelope for reconverting said amplified signal into a visible light output image, said reconverting means being a phosphor layer deposited upon a surface of said output window interior to said envelope and said coloring elements being color output filters formed from photographic film and positioned proximate said output window exterior to said envelope, said phosphor layer emitting several wavelengths of light in the visible region approximating white light when struck by said amplified signal, said several wavelengths of light propagating through said output window and said output filters, said output image being colorized, said at least two portions of said input filter means being three in number, a first passing red light, a second passing green light and a third passing blue light and wherein said at least two portions of said output coloring means are three in number, a first passing red light, a second passing green light and a third passing blue light, said output image attributable to incident light passing through red, green and blue input filters being colorized by red, green and blue output filters, respectively, each of said three portions of said output coloring means being borne upon an independent photographic film, said independent films having said red, green and blue output filters, respectively distributed over clear areas of said films such that when said films are stacked in a predetermined relative orientation, an RGB matrix is formed.

28. The device of claim 27, further including a fourth film which when assembled to said stacked films in a predetermined relative orientation thereto, constitutes a saturation mask characterized by having clear areas thereof aligning with said output filters and a remaining area thereof being non-transmissive to light.

29. An image intensifier for producing a colored output image, comprising:

(a) an evacuated envelope having an input window for receiving incident light from the environment into said intensifier and an output window through which and output image is projected from said intensifier;

(b) input filter means affixed proximate said input window for filtering said incident light, a first of at least two portions of said input filter means passing light in a first selected range of wavelengths and a second portion passing light in a second selected range of wavelengths said at least two portions of said input filter means each subdivided into a plurality of input filters interspersed and distributed in a generally planar configuration parallel to said input window;

(c) output coloring means affixed proximate said output window for coloring said output image, a first of at least two portions of said output coloring means providing light of one selected range of wavelengths and a second portion providing light of another selected range of wavelengths, said at least tow portions of said output coloring means each subdivided into a plurality of coloring elements interspersed and distributed in a generally planar configuration parallel to said output window, said output coloring means and said input filter means being stationary with respect to said intensifier when producing said output image and having a spatial alignment relative to each other, said input filters of said first portion of said input filter means having an approximate one-to-one correspondence with said coloring elements of said first portion of said output coloring means and said input filters of said second portion of said input filter means have an approximate one-to-one correspondence with said coloring elements of said second portion of said output coloring means such that incident light passing through said first and second portions of said input filter means generates an output signal from said intensifier which is colorized by said first and second portions, respectively, of said output coloring means to represent the coloring of said incident light; and (d) conversion means contained within said envelope for converting said incident light passing through said input window and said input filter means into a photoelectron signal, amplifying means contained within said envelope for amplifying said photoelectron signal into an amplified signal and reconverting means contained within said envelope for reconverting said amplified signal into a visible light output image, said reconverting means being a phosphor layer deposited upon a surface of said output window interior to said envelope and said coloring elements being color output filters formed from photographic film and positioned proximate said output window exterior to said envelope, said phosphor layer emitting several wavelengths of light in the visible region approximating white light when struck by said amplified signal, said several wavelengths of light propagating through said output window and said output filters, said output image being colorized, said at least two portions of said input filter means being three in number, a first passing red light, a second passing green light and a third passing blue light and wherein said at least two portions of said output coloring means are three in number, a first passing red light, a second passing green light and a third passing blue light, said output image attributable to incident light passing through red, green and blue input filters being colorized by red, green and blue output filters, respectively, each of said three portions of said output coloring means being borne upon a single positive color transparency photographic film having said red, green and blue output filters distributed thereover within a black matrix, such that said photographic film constitutes an RGB matrix.

30. The device of claim 29, further including a second film which when stacked against said transparency film at a predetermined relative orientation thereto, constitutes a saturation mask characterized by having clear areas thereof aligning with said output filters and a remaining area thereof being non-transmissive to light.

* * * * *